US009273874B2

(12) United States Patent
Al-Mehaini

(10) Patent No.: US 9,273,874 B2
(45) Date of Patent: Mar. 1, 2016

(54) AIR CONDITIONING AND VENTING SYSTEM

(76) Inventor: Qutaibah Al-Mehaini, Bayan (KW)

( * ) Notice: Subject to any disclaimer, the term of this patent is extended or adjusted under 35 U.S.C. 154(b) by 932 days.

(21) Appl. No.: 13/438,144

(22) Filed: Apr. 3, 2012

(65) Prior Publication Data

US 2013/0255300 A1 Oct. 3, 2013

(51) Int. Cl.

| | |
|---|---|
| ***F25B 39/04*** | (2006.01) |
| ***F25D 23/12*** | (2006.01) |
| ***F25B 27/00*** | (2006.01) |
| ***F24F 3/00*** | (2006.01) |
| ***F24F 1/00*** | (2011.01) |

(52) U.S. Cl.

CPC ..... *F24F 1/0003* (2013.01)

(58) Field of Classification Search

CPC .. F25B 13/00; F25B 2600/111; F25B 49/027; F25B 9/006; F25B 1/00; F25B 2339/047; F25B 27/002; Y02B 30/545; F24F 13/02; F24F 5/0035; F24F 2001/0088; F24F 1/0003

USPC ..... 62/259.4, 235.1; 165/205; 236/1 B; 454/237

See application file for complete search history.

(56) References Cited

U.S. PATENT DOCUMENTS

| | | | | | |
|---|---|---|---|---|---|
| 4,089,916 | A | * | 5/1978 | Hay | 261/153 |
| 4,285,390 | A | * | 8/1981 | Fortune et al. | 165/210 |
| RE31,321 | E | * | 7/1983 | Harrison | 126/585 |
| 4,843,832 | A | * | 7/1989 | Yamada et al. | 62/159 |
| 4,918,938 | A | * | 4/1990 | De Forest et al. | 62/238.6 |
| 5,174,128 | A | * | 12/1992 | Bourne et al. | 62/373 |
| 5,353,601 | A | | 10/1994 | Palmer | |
| 5,385,030 | A | | 1/1995 | Kitagawa et al. | |
| 5,467,604 | A | * | 11/1995 | Sekigami et al. | 62/117 |
| 5,911,745 | A | | 6/1999 | Conner | |
| 6,681,584 | B1 | | 1/2004 | Conner | |
| 7,370,490 | B2 | | 5/2008 | Li | |
| 2006/0234621 | A1 | * | 10/2006 | Desrochers et al. | 454/239 |
| 2010/0318226 | A1 | * | 12/2010 | Augusto et al. | 700/277 |

* cited by examiner

*Primary Examiner* — Allen Flanigan
*Assistant Examiner* — Filip Zec
(74) *Attorney, Agent, or Firm* — Hauptman Ham, LLP

(57) ABSTRACT

An air conditioning and ventilating system for a two-story building with a water tank disposed on the roof includes a first condenser unit and a first air handling unit for cooling a first set of primary cooled rooms and a first set of secondarily cooled rooms on an upper floor of the building. The system also includes a second condenser unit and a second air handling unit for cooling a second set of primarily cooled rooms and a second set of secondarily rooms on a lower floor and wherein the second condenser unit and second air handling unit are independent of the first condenser unit and first air handling unit. On both floors cool air from the first set of rooms is partially returned to the air handling units and partially recirculated into the primary cooled rooms.

3 Claims, 4 Drawing Sheets

AIR CONDITIONING AND VENTING SYSTEM

FIELD OF THE INVENTION

This invention relates to an air conditioning and venting system and more particularly to an air cooling and venting system that re-circulates cooled air.

BACKGROUND FOR THE INVENTION

The Middle East in general and the Gulf area in particular is an often prohibitive area in view of the very hot summers and a crisis of energy and the high level of energy consumption that are basically unbearable and costly in developing countries. In the hot desert area the air conditioner is not considered a luxury, but it is considered a main support to human life that is indispensable in spite of consuming energy. Fortunately, energy is cheap in some countries, but it is not free in all countries and even if it is free it is not an excuse to waste energy that has a negative effect on natural resources, the environment and also to human health. One of the major waste and cost is because of the inefficiency of air conditioning. Thus it is considered highly desirable to provide a central conditioning system that is less costly and uses less power without extra cost and at the same time provides healthy ventilation in air conditioned buildings without loss of cooling capacity.

Air conditioning and venting systems for buildings including residences are well known and have been in use for many years. For example, Palmer U.S. Pat. No. 5,353,601 discloses structural cooling systems and methods. As disclosed, a structural cooling system includes an evaporative cooler suitable for cooling a body of air in an upper, enclosed chamber of a structure, such as an attic, and a series of vents or ducts particularly around the perimeter of the building for applying the cold air selectively to high heat-gain portions of the exterior of the structure. An interior cooling system, which may include an air conditioning unit is suitable, for cooling the interior of the building, but will require only reduced capacity, because of the cooling effect on the exterior structures.

A more recent U.S. Pat. No. 6,681,584 of Conner discloses a method and apparatus for cooling and cleaning air. As disclosed, a method and apparatus for efficiently using various components in combination as a system for cooling and cleaning air. The apparatus uses the combination of an evaporative cooler with a water reservoir and a refrigerated air system with a water-cooled condenser. A pump or series of pumps are used to supply water to the evaporative cooler and to the water cooled condenser. A mechanism for controlling the hardness of supplied water may also be included.

After the reservoir water has been supplied to the other components in the system, it is returned to the water reservoir. During less humid summer conditions, the output air from the evaporative cooler is supplied in a series of ducts and is used to cool the interior of a structure such as a home. When the outside ambient temperature and/or humidity exceed the capabilities of the evaporative cooler for cooling the interior of the structure to the desired temperature, the output air from the evaporative cooler is partially redirected to one or more adjacent spaces of the structure and the refrigerated air from the refrigerated air system is used to cool the interior of the structure.

A portion of the output air from the evaporative cooler is also added to the air of the refrigerated air conditioning system to clean, humidify and pressurize the air going through the living spaces. By using the output air from the evaporative cooler to cool an adjacent space, the overall cooling load on the refrigerated air system is reduced. In addition, the use of the water from the evaporative cooler reservoir to condense the refrigerant vapors will enable the system to achieve even greater efficiency.

Finally, Li U.S. Pat. No. 7,370,490 discloses an air conditioning system with full heat recovery that comprises a condenser, an evaporator, a compressor and an expansion valve. One side of the condenser is disposed in a position corresponding to an indoor air outlet and an outdoor air inlet. The other side of the condenser is provided with an exhaust vent and a cooling fan disposed between the exhaust vent and a cooling air opening. The air conditioning system with full heat recovery can be connected with a condensate recycle system, thus the present invention utilizes low temperature, low humidity, indoor exhaust air as cooling air for the evaporative condenser. It makes use of the sensible heat (temperature difference) of indoor exhaust air as well as the latent heat (humidity difference) of indoor exhaust air, thereby attaining better condensation effects. It also uses the condensate to assist cooling and increase cooling and water saving effects. Thus, the system can be widely used in the air conditioning systems in restaurants, hospitals, super markets, villas and offices and has wide applications.

Notwithstanding the above, it is presently believed that there is a need and a potential commercial market for an improved air conditioning and venting system in accordance with the present invention. There should be a need and a potential market for such systems because they should reduce the cost of operating such systems, reduce the use of electrical energy and even lead to a reduction in maintenance and replacement costs for such systems. It is also believed that systems in accordance with the present invention can be manufactured and sold at a competitive price, readily serviced and at the same time used to cool and/or heat water and reduce water evaporation.

BRIEF SUMMARY OF THE INVENTION

In essence, the present invention contemplates an air conditioning and venting system for an enclosed structure as for example a multi-story building. As contemplated, the air conditioned and venting system comprises or consists of a first condenser unit that is connected to a compressor for cooling a mass of air for a set of rooms on an upper floor of the building as well as a water tank disposed on a roof of the building. The system also includes an air handling evaporation unit and a first series of ducts for directing cooled air into a first set of rooms and a second of said set of ducts for re-circulating and further cooling air from the first set of rooms back into the air handling unit. A third set of ducts directs a portion of the cooled air from the first set of rooms into a second set of rooms while a fourth set of ducts directs air from the second set of rooms into a space between a sun shield and the water tank on the roof of the building. The system also includes a second condenser unit, compressor and a second air handling unit that are separate or independent of the first condenser unit and first air handling unit for cooling and circulating a separate mass of air for cooling two sets of rooms on a lower floor. The second system directs previously cooled air from the second air handling unit into a living room and bedroom on the lower floor and recirculates a portion of that air from those areas through the second air handling unit for further cooling. A fifth series of ducts directs previously cooled air from the living room and bedroom into a kitchen and bathroom and back to the second air handling unit. The second air handling unit also exhausts heat to the outside of the building.

In a preferred embodiment of the invention, an air conditioning and ventilating system is used in an enclosed multi-story building having a roof with a water tank disposed thereon. The system consists of a multi-story building including an upper floor, a lower floor, walls and a roof enclosing the building. A sun shield is provided for reflecting the direct rays of the sun and a water tank disposed with and surrounded by the sun shield with a space between the water tank and sun shield. The sun shield and water tank are disposed above the upper floor (on the roof) of the building. The upper floor of the building includes a first set of primarily cooled rooms, a first set of secondarily cooled rooms and a lower air vent connecting the first and second sets of rooms. The lower floor of the building includes a third set of primarily cooled rooms, a fourth set of secondarily cooled rooms and a lower air vent connecting the third set of rooms and the fourth set of rooms.

In addition, a first part of the system includes a first condenser unit, a compressor and a first air handling evaporator unit for cooling a mass of air from between the sun shield and the water tank and the second air handling and ventilating unit for cooling air recycled from the primarily cooled rooms. The first air handling and ventilating unit delivers cooled air from the first air condenser unit and re-cooled recycled air to the primarily cooled rooms and circulating a portion of the air from the previously cooled rooms to the secondarily cooled rooms through the lower air vents connecting the primary cooled set of rooms and the secondarily cooled rooms and from the secondarily cooled rooms by a further air duct to the space between the sun shield and the water tank.

The system will now be described in connection with the accompanying drawings wherein like reference numerals have been used to indicate like parts.

DESCRIPTION OF THE PREFERRED EMBODIMENTS OF THE INVENTION

Figure 1:
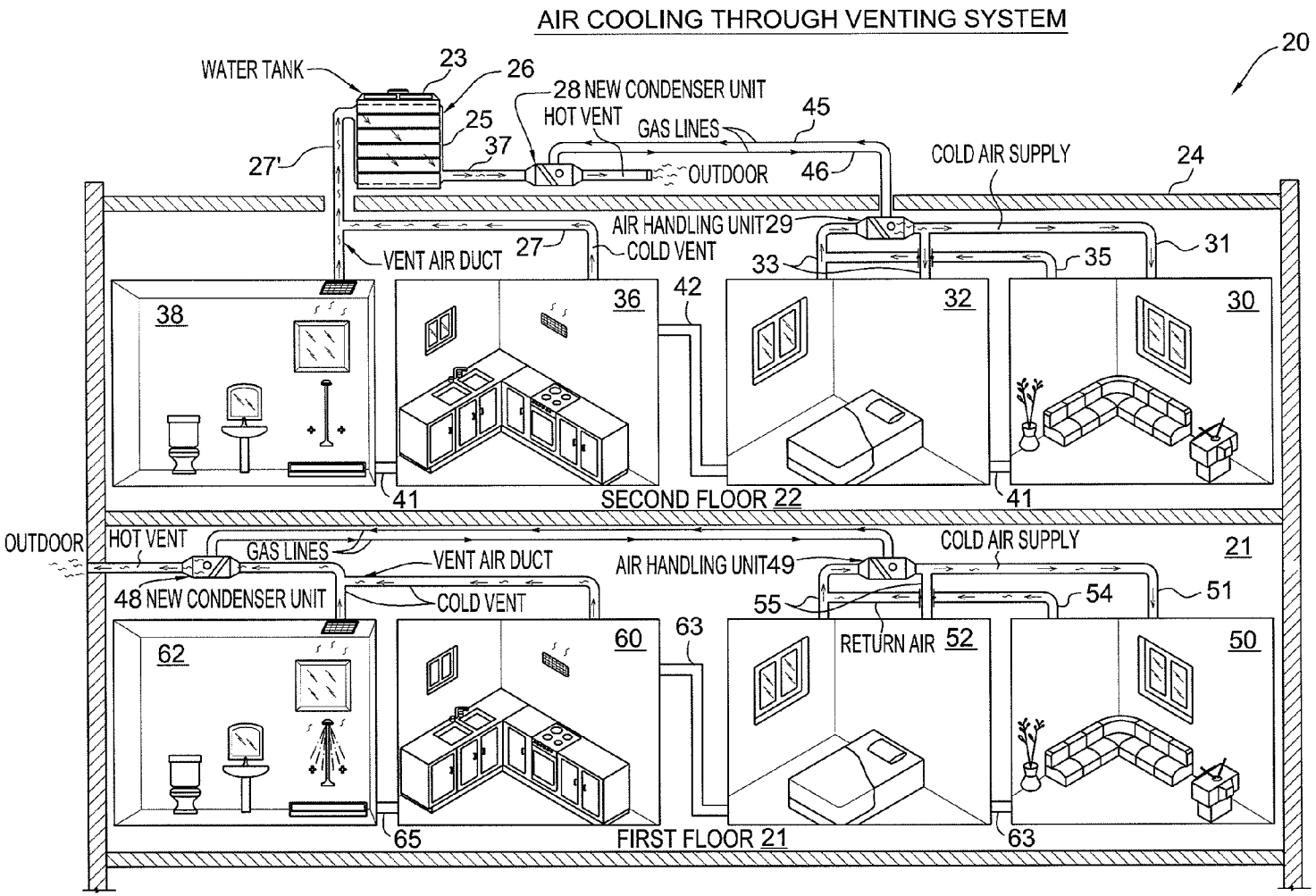
FIG. 1 is a schematic illustration of a two story concrete building with an air conditioning and venting system in accordance with a preferred embodiment of the present invention.

As illustrated in FIG. 1 a two story concrete building 20 includes a lower floor 21, an upper floor 22 and water tank 23 on the roof 24 or perhaps in an attic of the building 20. As shown in FIG. 1 the water tank 23 is surrounded by an insulating shell 25 that may be of metal as for example a chrome plated steel for reflecting the sun's rays and may be lined with an insulating layer of polystyrene or the like. The shell 25 receives cooled air from the upper floor 22 and exhausts the air after passing through the shell 25 and cooling the tank 23 from a duct 27 when it is fed into a condenser unit 28 and hot hair is exhausted outside of the building as shown.

An air handling unit 29 also serves as a refrigerant and directs cooled air through a series of ducts 31 and 33 to rooms 30 and 32 to cool those rooms. A further series of ducts 35 and 37 re-circulate some of the previously cooled air from rooms 30 and 32 back into the air handling and cooling unit 29. A portion of the cooled air from rooms 30 and 32 passes through the ducts 41, 42 and 43 and into a kitchen 36 and bathroom 38 for cooling those rooms. The cooled air from rooms 36 and 38 passes through the ducts 27 and 27' and into a space between the sun shield 25 and water tank 23. The cooled air tends to cool water in the tank 23 and then passes through a duct 37 and into the condenser unit 28. Hot air from the second floor set of rooms and between the water tank and sun shield is exhausted outside of the building 20 by the unit 28.

A gas line 45 and liquid (gas) line 46 allows compressed refrigerant such as Freon to circulate from a compressor 50 in unit 28 (see FIGS. 2 and 3) to the air handling unit 29 and gaseous refrigerant from the unit 29 back to the unit 28. In essence, units 28 and 29 and compressor 50 act as an air conditioning system.

A second air conditioning and venting system for a lower or first floor 21 includes a second condenser unit 48, a second air handling unit 49 and compressor 50 act as a second air conditioning system. The cold air supply from the air handling unit 49 is fed to a living room 50' and bedroom 52 by ducts 51 and 53. A portion of the air from the room 50' and 52 is recycled by ducts 54 and 55 and re-cooled. Cooled air from rooms 50' and 52 is directed into a kitchen 60 and bathroom 62 to cool those rooms by ducts 61, 63 and 65.

Figure 2:
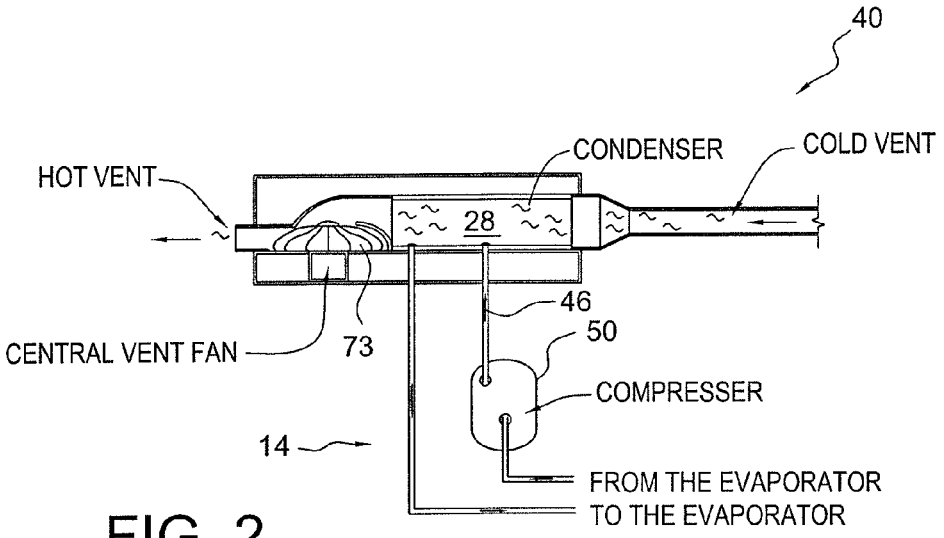
FIG. 2 is a schematic illustration of a refrigeration unit as used in the present invention.
Figure 3:
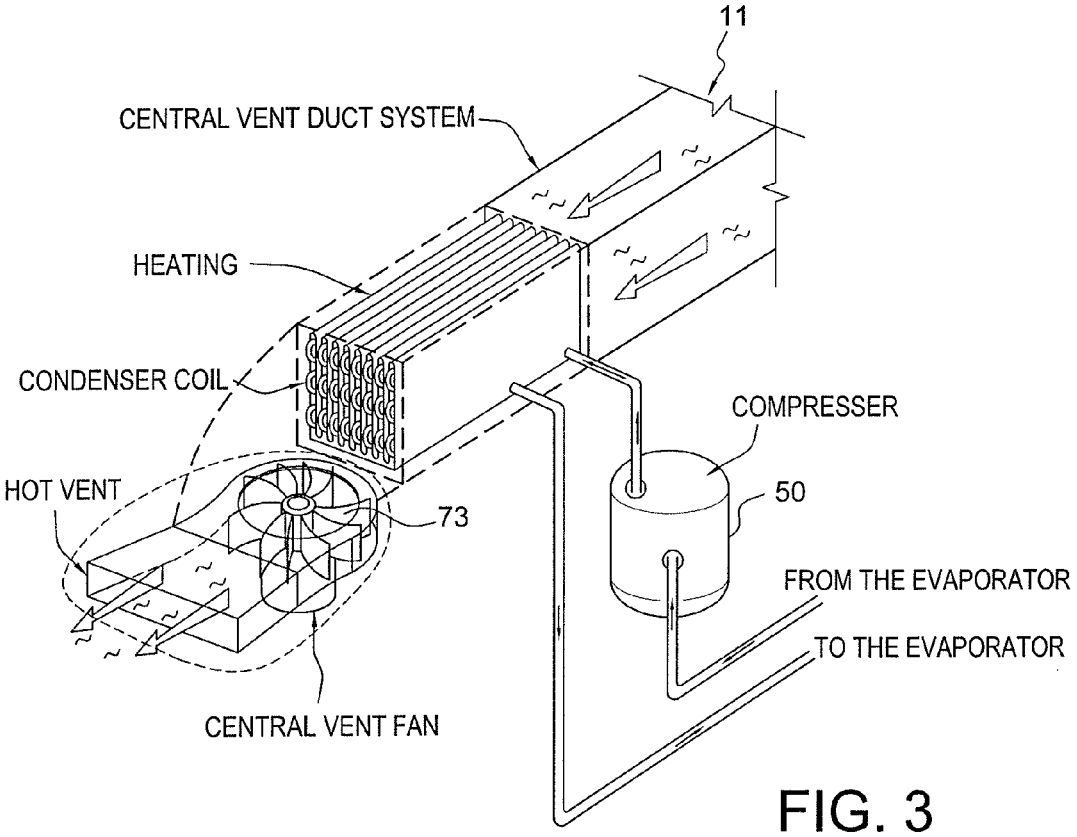
FIG. 3 is a perspective view of the refrigeration unit shown in FIG. 2.

As illustrated in FIGS. 2 and 3 a condenser unit 28 includes the compressor 50 and expansion valve 71 (see FIG. 5), as well as a condenser coil and a central vent fan 73 operates in a conventional manner. For example, the compressor compresses cooled Freon gas causing it to become hot high pressure liquid Freon. The hot Freon then passes into and through an expansion valve and set of coils allowing it to dissipate heat as it condenses into a liquid. This liquid passes through an expansion valve and evaporates to become cold low pressure gas. The cold low pressure gas passes through a set of coils that allows the gas to absorb heat and cool down the air inside of a building.

Figure 4:
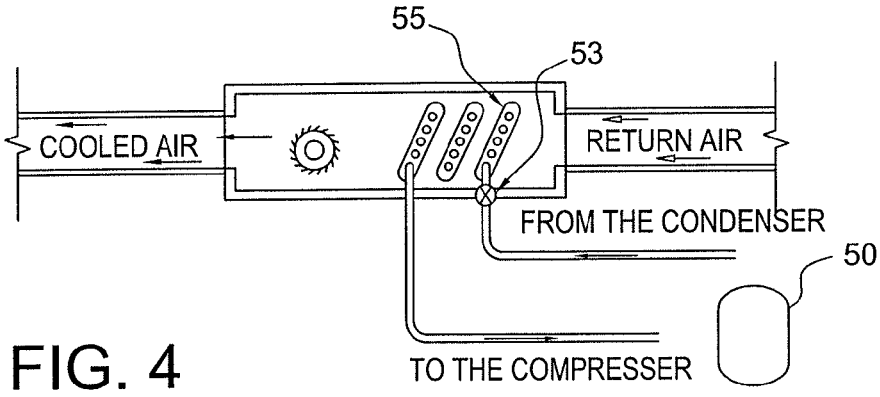
FIG. 4 is schematic view of an air handling unit as used in the present invention.
Figure 5:
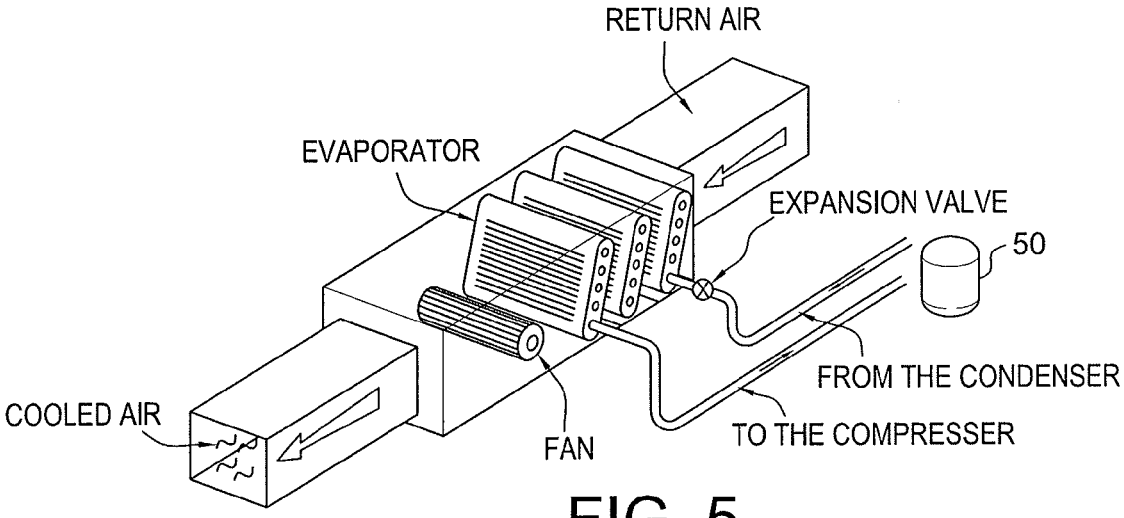
FIG. 5 is a perspective view of the evaporation unit shown in FIG. 4.
Figure 6:
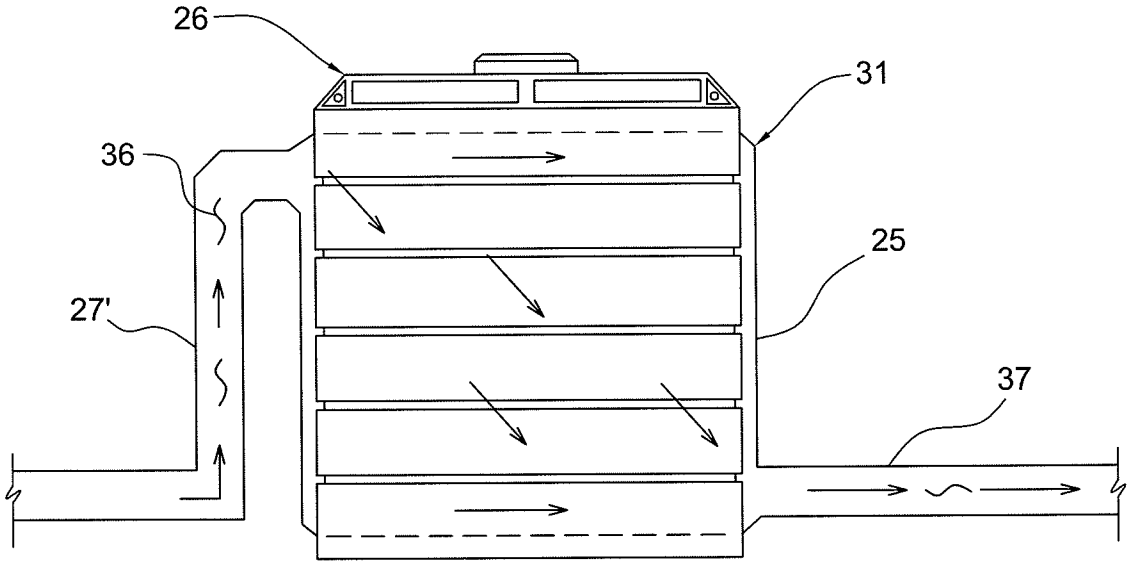
FIG. 6 is side view of a sun shield and water tank as used in the present invention.

The air handling unit 29 illustrated in FIGS. 4 and 5 receives Freon gas from the condenser 29 through the gas line 45 and directs the Freon through an expansion valve 71 into an evaporator. The air returned from the rooms 30 and 32 is re-cooled and returned to the rooms 30 and 32 by a fan 73 (see FIGS. 2 and 3). The gaseous Freon is returned to a compressor by the line 46 (see FIG. 1).

The water tank 23 in the preferred embodiment of the invention is surrounded by the sun shield 25 that forms an enclosed chamber with the water tank therein. Thus cooling air is recycled into and cooled by the condenser unit 28 and distributed to the rooms 30 and 32.

The condenser 28 will now be described with reference to FIGS. 4 and 5. However, before progressing to FIGS. 4 and 5, it should be recognized that in FIG. 1 there are two condenser units 28 and 48. The first condenser unit 28 receives cooled air from between the shell 31 and tank 26 that was directed to the tank 26 from a kitchen 36 and bathroom 38 on the upper floor 24 of the building 20. The second condenser unit 48 receives cooled air from a kitchen 60 and bathroom 62 on the first floor.

For example, the condenser 28 includes a central vent fan that draws cooled air and compressed hot gases from a compressor 50 into and through the condenser and exhausts heat into the outdoors. The compressed hot refrigerant from the compressor 50 is fed to the condenser 28 and returned to an evaporator (not shown). An air handling unit 49 includes an expansion valve 53 and evaporator 55. As shown in FIGS. 4 and 5 the evaporator unit includes a fan 73 that draws return air from the living room 50' and bedroom 52 in the upper floor into the evaporator unit.

As illustrated in FIG. 1, the air handling unit is coupled to compressor (see FIGS. 2 and 3) that receives cooled refrigerant gas and compresses it into a hot high pressure gas. The hot high pressure gas passes through a set of coils to dissipate heat and it is then condensed into a liquid. Then the liquid runs through an expansion valve and in the process it evaporates to become cooled low pressure Freon gas. This cold gas passes through a series of coils that allow the gas to absorb heat and cool down the air inside of the building.

Returning now to FIG. 1, the air from between the water tank 23 and shell 25 is directed into the condenser unit 28 and hot air is exhausted to the outdoors. At the same time, hot condensed Freon is delivered by a compressor and from the compressor 50 goes to the condenser 28. The hot Freon gas from the compressor 50 runs through a set of coils so that it can dissipate heat and subsequently return to the compressor. At the same time cold air from an air handling unit 29 is delivered to a living room and bedroom on the upper floor and return air is directed back into the air handling unit by means of ducts.

The cooling and ventilating systems for the first floor operates in a similar manner but do not incorporate a roof mounted water tank. In a first floor system an air handling system includes a compressor and incorporates and receives air returned from a living room and bedroom. The returned air passes into the air handling unit and is cooled and directed back into the living room and bedroom. The semi cooled air from the kitchen and bathroom on the first floor is fed into a second condenser 48 unit and heated air is exhausted outside of the building. Nevertheless hot Freon gas from a compressor is fed to a second air handling unit 49 and cooled Freon gas flows back to the second condenser unit 48.

While the invention has been disclosed in connection with its preferred embodiments it should be recognized that changes and modifications may be made therein without departing from the scope of the claims.

What is claimed is:

1. An air conditioning and ventilating system for a multi-story enclosed concrete structure, said air conditioning and ventilating system comprising:

a multi-story concrete structure having an upper floor and a lower floor, outer walls and a roof enclosing said structure and a first set of rooms including primarily cooled rooms and secondarily cooled rooms on said upper floor that are cooled by air from said previously cooled rooms; and a second set of rooms including primarily cooled rooms and secondarily cooled rooms on a lower floor and, an enclosure comprising a sunshield for reflecting the direct rays of sun, and a water tank disposed within said enclosure and underneath said sun shield with an air circulating space between said water tank and said sun shield and having a first inlet air duct and a second outlet air duct, wherein said enclosure is disposed on said roof;

a first condenser unit and a first air handling unit for cooling said first set of rooms including said first primarily cooled rooms, first secondarily cooled rooms and said water tank and exhausting hot air outside of the structure; and a second condenser unit and second air handling unit for cooling said second set of rooms including said second primarily cooled rooms and said second secondarily cooled rooms and exhausting heated air outside of said structure;

wherein air cooled by said first air handling unit is directed into a first set of primary cooled rooms with a portion of said cooled air from said primarily cooled rooms directed into a first set of secondarily cooled rooms and from said secondary cooled rooms to said enclosed water tank and back into said first condenser unit and a portion of the cooled air recirculated back to said first air handling unit to be further cooled and redirected into said first primarily cooled rooms; and wherein an air cooled by said second condenser unit and handled by said second air handling unit is directed into a second set of primarily cooled rooms living room and bedroom with a portion of said cooled air from said primarily cooled rooms directed into a secondary cooled room or rooms of said second set of rooms and a portion recirculated back into said second air handling system for further cooling and directing back into said primarily cooled room in said second set.

2. An air conditioning and ventilation system for an enclosed multi-story building having a roof with a water tank disposed thereon, said air conditioning and ventilation system consisting of:

a multi-story building including an upper floor, a lower floor, walls and a roof enclosing the building;

an enclosure comprising a sun shield for reflecting the direct rays of the sun and a water tank disposed within said enclosure and underneath said sun shield with an air circulating space between said water tank and said sun shield and having a first inlet air duct and a second outlet duct, and wherein said sun shield and said water tank are disposed above said upper floor on said roof of said building;

said upper floor of said building including a first set of primarily cooled rooms, a second set of secondarily cooled rooms and a lower air vent connecting said first and second sets of room;

said lower floor of said building including a third set of primarily cooled rooms and a fourth set of secondarily cooled rooms and a lower air vent connecting said third set of rooms and said fourth set of rooms;

a first refrigeration/ventilating unit for cooling a mass of air from between said sun shield and said water tank and a second refrigeration/ventilation unit for cooling air recycled from said primarily cooled rooms and delivering cold air from said first refrigeration/ventilating units and re-cooled recycled air to said primarily cooled rooms and circulating a portion of said air from said primarily cooled rooms to said secondarily cooled rooms through said lower air vent connecting said primarily cooled set of rooms and said secondarily cooled rooms and from said secondarily cooled rooms by said second air outlet duct from the air circulating space between said sun shield and said water tank; and a third refrigeration/ventilating unit for cooling a mass of air from said third set of rooms and directing the re-cooled air into said third set of rooms and a portion of cooled air from said third set of rooms to said fourth set of rooms while exhausting heat to an outside of said building.

3. An air conditioning and ventilation system for an enclosed multi-story building having a roof with a water tank disposed thereon, said air conditioning and ventilation system comprising:

a multi-story building including an upper floor, a lower floor, walls and a roof enclosing the building;

an enclosure comprising a sun shield for reflecting the direct rays of the sun and a water tank disposed within said enclosure and underneath said sun shield with an air circulating space between said water tank and said sun shield and having a first inlet air duct and a second outlet air duct, and wherein said sun shield and said water tank are disposed above said upper floor on said roof of said building;

said upper floor of said building including a first set of primarily cooled rooms, a second set of secondarily cooled rooms and a lower air vent connecting said first and second sets of room;

said lower floor of said building including a third set of primarily cooled rooms and a fourth set of secondarily cooled rooms and a lower air vent connecting said third set of rooms and said fourth set of rooms;

a first refrigeration/ventilating unit for cooling a mass of air from between said sun shield and said water tank and a second refrigeration/ventilation unit for cooling air recycled from said primarily cooled rooms and delivering cold air from said first refrigeration/ventilating units and re-cooled recycled air to said primarily cooled rooms and circulating a portion of said air from said primarily cooled rooms to said secondarily cooled rooms through said lower air vent connecting said primarily cooled set of rooms and said secondarily cooled rooms and from said secondarily cooled rooms by said second air outlet duct from the air circulating space between said sun shield and said water tank; and a third refrigeration/ventilating unit for cooling a mass of air from said third set of rooms and directing the re-cooled air into said third set of rooms and a portion of cooled air from said third set of rooms to said fourth set of rooms while exhausting heat to an outside of said building.

* * * * *